United States Patent [19]

Bertelsen

[11] 4,069,770

[45] Jan. 24, 1978

[54] TABLE WITH AN UNDIVIDED TABLE-TOP

[76] Inventor: Henry Filso Bertelsen, Kibaek Mobelfabrik, DK-6933 Kibaek, Denmark

[21] Appl. No.: 682,155

[22] Filed: Apr. 30, 1976

[30] Foreign Application Priority Data

May 5, 1975 Denmark ..... 1941/75

[51] Int. Cl.[2] ..... A47B 1/05

[52] U.S. Cl. ..... 108/66

[58] Field of Search ..... 108/66, 69, 71, 73, 108/72, 74, 75

[56] References Cited

U.S. PATENT DOCUMENTS

| | | | |
|---|---|---|---|
| 1,274,475 | 8/1918 | Wanner | 108/66 |
| 1,384,925 | 7/1921 | Seiler | 108/66 |
| 2,492,139 | 12/1949 | Eliason | 108/66 |
| 2,703,740 | 3/1955 | Cochard | 108/66 |
| 3,636,891 | 1/1972 | Bertelsen | 108/66 |
| 3,703,871 | 11/1972 | Bertelsen | 108/66 |

*Primary Examiner*—Roy D. Frazier
*Assistant Examiner*—Darrell Marquette
*Attorney, Agent, or Firm*—Kenyon & Kenyon

[57] ABSTRACT

The table is provided with extension leaves which can be stored in a concealed position under the main table top. The underframe of the table has a top and bottom which serve to support the extension leaves in the extended position and the retracted position. The table top has a downwards facing edge. In a preferred embodiment the sliding bars are broad but of small height and form an angle to each other.

3 Claims, 2 Drawing Figures

TABLE WITH AN UNDIVIDED TABLE-TOP

The invention relates to a table with undivided table top and with extensions of the draw type, each comprising sliding bars which are arranged for sliding on the top side of the table frame, and double-lying leaves, which are arranged for being turned out for location side by side.

The object of the invention is to provide a table of the said type, in which the edge of the extension leaves is concealed. Because the curved shape of the extension leaves differs from that of the table top, it is not quite satisfactory, that they are visible in the inserted position.

The table according to the invention is characteristic in that the frame carries a cross-member, which again carries a table top and a table bottom of less extent than the diameter or transverse measurement of the table, between which the sliding bars are located in such a manner, that the cross-member guides the horizontal movement of the sliding bars by engaging their free ends, and that the table bottom supports the sliding bars in the inserted position, whereas the table top and the frame support the sliding bars in the extended position, whereby the table top is provided with a downwards facing edge.

It will be seen, that the downwards facing edge of the table top and the frame are altogether concealing the extension leaves in the inserted position.

Figure 1:
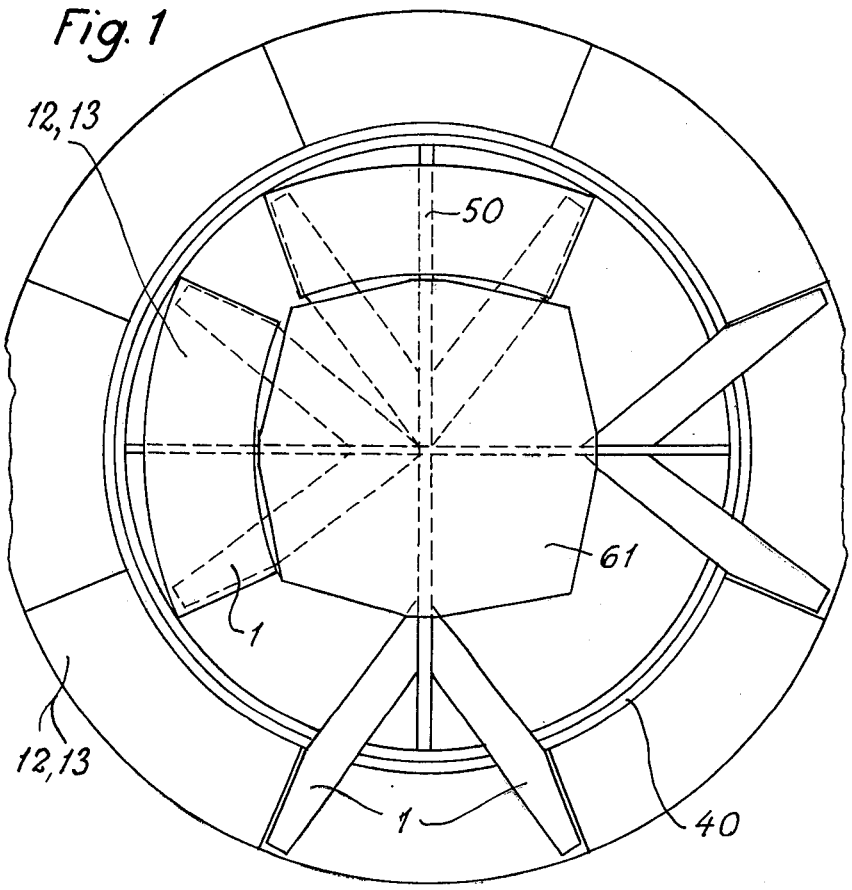

The invention will be explained more detailed with reference to the drawing, in which FIG. 1 shows an embodiment of the table according to the invention with the table top removed, and FIG. 2 same in section with the table top in its place.

The table in the drawing, where the table legs have been left out, has a table top 11, which can be raised and lowered, with a downwards facing edge 70 and a frame 40 with a cross-member 50, having radiating arms 51, as shown in FIG. 1. The cross member carries a top plate 61 as well as a bottom plate 62. As shown, the top plate 61 is carried above the cross member in spaced relation to the bottom plate 62 which is carried below the cross member 50. Both the plates 61, 62 are of less extent than the table top 11. As shown, a plurality of pairs of sliding bars 1 are slidably mounted between the plates 61, 62. These sliding bars 1 are characteristic in being broad but of small height, and the ends of which are guided in horizontal direction by resting against the arms 51 of the cross-member 50.

Because of the downwards facing edge 70 and the frame 40, the extension leaves 12,13 are concealed to the spectator in the inserted position.

Figure 2:
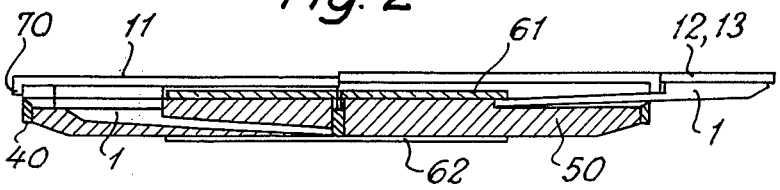

In the embodiment shown the table height is a little larger in the extended position than with inserted extension leaves, as appears from the right half of FIG. 2 as compared with the left half of the figure.

The table height can be kept invariable in both positions, if sliding bars of steel are used.

For the guidance of the extension leaves the frame 40 is a little elevated between the two branches of the V-shaped sliding bars.

I claim:

1. A table comprising an undivided circular table top having a downwardly facing peripheral edge;

a frame below said table top;

a cross-member carried in said frame and having radiating arms;

a bottom plate carried below said cross-member, said bottom plate being of less extent than said table top;

a top plate carried above said cross-member in spaced relation to said bottom plate, said top plate being of less extent than said table top;

a plurality of pairs of extension leaves; and a plurality of pairs of sliding bars slidably mounted between said plates, each pair of said sliding bars supporting a pair of said extension leaves, each said pair of sliding bars being slidable between an inserted position and an extended position relative to said plates to selectively position a respective pair of extension leaves under said table top in a concealed manner and astride said table top, each said sliding bar having a free end slidable along an arm of said cross-member whereby said pairs of sliding bars are disposed on said frame and under said top plate in said extended position and between said plates in said inserted position.

2. A table as set forth in claim 1 wherein each sliding bar is broad and of small height.

3. A table as set forth in claim 2 wherein each sliding bar is disposed at an angle of 45° relative to a respective arm of said cross-member.

* * * * *